US008225883B2

(12) United States Patent
Hall et al.

(10) Patent No.: US 8,225,883 B2
(45) Date of Patent: Jul. 24, 2012

(54) DOWNHOLE PERCUSSIVE TOOL WITH ALTERNATING PRESSURE DIFFERENTIALS

(75) Inventors: David R. Hall, Provo, UT (US); Scott Dahlgren, Alpine, UT (US); Jonathan Marshall, Provo, UT (US)

(73) Assignee: Schlumberger Technology Corporation, Houston, TX (US)

( * ) Notice: Subject to any disclaimer, the term of this patent is extended or adjusted under 35 U.S.C. 154(b) by 379 days.

(21) Appl. No.: 12/415,188

(22) Filed: Mar. 31, 2009

(65) Prior Publication Data

US 2009/0183919 A1 Jul. 23, 2009

Related U.S. Application Data

(63) Continuation-in-part of application No. 12/178,467, filed on Jul. 23, 2008, now Pat. No. 7,730,975, which is a continuation-in-part of application No. 12/039,608, filed on Feb. 28, 2008, now Pat. No. 7,762,353, which is a continuation-in-part of application No. 12/037,682, filed on Feb. 26, 2008, now Pat. No. 7,624,824, which is a continuation-in-part of application No. 12/019,782, filed on Jan. 25, 2008, now Pat. No. 7,617,886, which is a continuation-in-part of application No. 11/837,321, (Continued)

(51) Int. Cl.
*E21B 10/26* (2006.01)

(52) U.S. Cl. ..... 175/57; 175/324; 175/389

(58) Field of Classification Search ..... 175/57, 175/324, 389, 296, 385
See application file for complete search history.

(56) References Cited

U.S. PATENT DOCUMENTS 465,103 A 12/1891 Wegner (Continued)

OTHER PUBLICATIONS

PCT International Preliminary Report on Patentability Chapter 1 for PCT/US07/64544, mailed Sep. 30, 2008.

(Continued)

*Primary Examiner* — Hoang Dang
(74) *Attorney, Agent, or Firm* — Brinks Hofer Gilson & Lione

(57) ABSTRACT

A downhole percussive tool is disclosed comprising an interior chamber and a piston element slidably sitting within the interior chamber forming two pressure chambers on either side. The piston element may slide back and forth within the interior chamber as drilling fluid is channeled into either pressure chamber. Input channels supply drilling fluid into the pressure chambers and exit orifices release that fluid from the same. An exhaust orifice allows additional drilling fluid to release from the interior chamber. The amount of pressure maintained in either pressure chamber may be controlled by the size of the exiting orifices and exhaust orifices. In various embodiments, the percussive tool may form a downhole jack hammer or vibrator tool.

20 Claims, 9 Drawing Sheets

Related U.S. Application Data filed on Aug. 10, 2007, now Pat. No. 7,559,379, which is a continuation-in-part of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,579, which is a continuation-in-part of application No. 11/611,310, filed on Dec. 15, 2006, now Pat. No. 7,600,586, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, and a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196, which is a continuation-in-part of application No. 11/555,334, filed on Nov. 1, 2006, now Pat. No. 7,419,018.

U.S. PATENT DOCUMENTS

| | | | | |
|---|---|---|---|---|
| 616,118 | A | | 12/1898 | Kuhne |
| 923,513 | A | | 6/1909 | Hardsocg |
| 946,060 | A | | 1/1910 | Looker |
| 1,116,154 | A | | 11/1914 | Stowers |
| 1,183,630 | A | | 5/1916 | Bryson |
| 1,189,560 | A | | 7/1916 | Gondos |
| 1,360,908 | A | | 11/1920 | Everson |
| 1,372,257 | A | | 3/1921 | Swisher |
| 1,387,733 | A | | 8/1921 | Midgett |
| 1,460,671 | A | | 7/1923 | Hebsacker |
| 1,544,757 | A | | 7/1925 | Hufford |
| 1,619,328 | A | | 3/1927 | Benckenstein |
| 1,746,455 | A | | 2/1930 | Woodruff et al. |
| 1,746,456 | A | | 2/1930 | Allington |
| 1,821,474 | A | | 9/1931 | Mercer |
| 1,836,638 | A | | 12/1931 | Wright et al. |
| 1,879,177 | A | | 9/1932 | Gault |
| 2,022,101 | A | | 11/1935 | Wright |
| 2,054,255 | A | | 9/1936 | Howard |
| 2,064,255 | A | | 12/1936 | Garfield |
| 2,100,692 | A | | 11/1937 | Harman |
| 2,169,223 | A | | 8/1939 | Christian |
| 2,196,940 | A | | 4/1940 | Potts |
| 2,218,130 | A | | 10/1940 | Court |
| 2,227,233 | A | | 12/1940 | Scott et al. |
| 2,300,016 | A | | 10/1942 | Scott et al. |
| 2,320,136 | A | | 5/1943 | Kammerer |
| 2,345,024 | A | | 3/1944 | Bannister |
| 2,371,248 | A | | 3/1945 | McNamara |
| 2,375,335 | A | | 5/1945 | Walker |
| 2,466,991 | A | | 4/1949 | Kammerer |
| 2,498,192 | A | | 2/1950 | Wright |
| 2,540,464 | A | | 2/1951 | Stokes |
| 2,545,036 | A | | 3/1951 | Kammerer |
| 2,575,173 | A | | 11/1951 | Johnson |
| 2,619,325 | A | | 11/1952 | Arutunoff |
| 2,626,780 | A | | 1/1953 | Ortloff |
| 2,643,860 | A | | 6/1953 | Koch |
| 2,725,215 | A | | 11/1955 | Macneir |
| 2,735,653 | A | * | 2/1956 | Bielstein ..... 91/40 |
| 2,746,721 | A | | 5/1956 | Moore |
| 2,755,071 | A | | 7/1956 | Kammerer |
| 2,776,819 | A | | 1/1957 | Brown |
| 2,807,443 | A | | 9/1957 | Wyman |
| 2,819,041 | A | | 1/1958 | Beckham |
| 2,819,043 | A | | 1/1958 | Henderson |
| 2,838,284 | A | | 6/1958 | Austin |
| 2,868,511 | A | | 1/1959 | Barrett |
| 2,873,093 | A | | 2/1959 | Hildebrandt |
| 2,877,984 | A | | 3/1959 | Causey |
| 2,894,722 | A | | 7/1959 | Buttolph |
| 2,901,223 | A | | 8/1959 | Scott |
| 2,942,850 | A | | 6/1960 | Heath |
| 2,942,851 | A | | 6/1960 | Wm |
| 2,963,102 | A | | 12/1960 | Smith |
| 2,998,085 | A | | 8/1961 | Dulaney |
| 3,036,645 | A | | 5/1962 | Scott |
| 3,055,443 | A | | 9/1962 | Edwards |
| 3,058,532 | A | | 10/1962 | Lee |
| 3,059,708 | A | | 10/1962 | Cannon et al. |
| 3,075,592 | A | | 1/1963 | Cannon |
| 3,077,936 | A | | 2/1963 | Armais |
| 3,105,560 | A | * | 10/1963 | Zublin ..... 175/56 |
| 3,135,341 | A | | 6/1964 | Ritter |
| 3,139,147 | A | | 6/1964 | Hays |
| 3,163,243 | A | | 12/1964 | Cleary |
| 3,199,617 | A | | 8/1965 | White |
| 3,216,514 | A | | 11/1965 | Nelson |
| 3,251,424 | A | * | 5/1966 | Brooks ..... 175/56 |
| 3,294,186 | A | | 12/1966 | Buell |
| 3,301,339 | A | | 1/1967 | Pennebaker, Jr. |
| 3,303,899 | A | | 2/1967 | Jones, Jr. |
| 3,336,988 | A | | 8/1967 | Jones, Jr. |
| 3,346,060 | A | | 10/1967 | Rex |
| 3,379,264 | A | | 4/1968 | Cox |
| 3,387,673 | A | | 6/1968 | Thompson |
| 3,429,390 | A | | 2/1969 | Bennett |
| 3,433,331 | A | | 3/1969 | Heyberger |
| 3,455,158 | A | | 7/1969 | Richter |
| 3,493,165 | A | | 2/1970 | Schonfeld |
| 3,583,504 | A | | 6/1971 | Aalund |
| 3,635,296 | A | | 1/1972 | Lebourg |
| 3,700,049 | A | | 10/1972 | Rouviere et al. |
| 3,732,143 | A | | 5/1973 | Joosse |
| 3,765,493 | A | | 10/1973 | Rosar et al. |
| 3,807,512 | A | | 4/1974 | Pogonowski |
| 3,815,692 | A | | 6/1974 | Varley |
| 3,821,993 | A | | 7/1974 | Kniff et al. |
| 3,885,638 | A | | 5/1975 | Skidmore |
| 3,899,033 | A | | 8/1975 | Van Huisen et al. |
| 3,955,635 | A | | 5/1976 | Skidmore |
| 3,960,223 | A | | 6/1976 | Kleine |
| 3,978,931 | A | | 9/1976 | Sudnishnikov et al. |
| 4,081,042 | A | | 3/1978 | Johnson |
| 4,096,917 | A | | 6/1978 | Harris |
| 4,106,577 | A | | 8/1978 | Summers |
| 4,165,790 | A | | 8/1979 | Emmerich |
| 4,176,723 | A | | 12/1979 | Arceneaux |
| 4,253,533 | A | | 3/1981 | Baker |
| 4,262,758 | A | | 4/1981 | Evans |
| 4,280,573 | A | | 7/1981 | Sudnishnikov et al. |
| 4,304,312 | A | | 12/1981 | Larsson |
| 4,307,786 | A | | 12/1981 | Evans |
| 4,386,669 | A | | 6/1983 | Evans |
| 4,397,361 | A | | 8/1983 | Langford |
| 4,416,339 | A | | 11/1983 | Baker |
| 4,445,580 | A | | 5/1984 | Sahley |
| 4,448,269 | A | | 5/1984 | Ishikawa et al. |
| 4,478,296 | A | | 10/1984 | Richman |
| 4,499,795 | A | | 2/1985 | Radtke |
| 4,531,592 | A | | 7/1985 | Hayatdavoudi |
| 4,535,853 | A | | 8/1985 | Ippolito et al. |

4,538,691 A 9/1985 Dennis
4,566,545 A 1/1986 Story et al.
4,574,895 A 3/1986 Dolezal
4,583,592 A 4/1986 Gazda et al.
4,592,432 A 6/1986 Williams
4,597,454 A 7/1986 Schoeffler
4,612,987 A 9/1986 Cheek
4,615,399 A 10/1986 Schoeffler
4,624,306 A 11/1986 Traver et al.
4,637,479 A * 1/1987 Leising ..... 175/26
4,640,374 A 2/1987 Dennis
4,679,637 A 7/1987 Cherrington
4,683,781 A 8/1987 Kar et al.
4,732,223 A 3/1988 Schoeffler et al.
4,775,017 A 10/1988 Forrest et al.
4,817,739 A 4/1989 Jeter
4,819,745 A 4/1989 Walter
4,821,819 A 4/1989 Whysong
4,830,122 A 5/1989 Walter
4,836,301 A * 6/1989 Van Dongen et al. ..... 175/61
4,852,672 A 8/1989 Behrens
4,875,531 A 10/1989 Biehl
4,889,017 A 12/1989 Fuller et al.
4,889,199 A 12/1989 Lee
4,907,665 A 3/1990 Kar et al.
4,962,822 A 10/1990 Pascale
4,974,688 A 12/1990 Helton
4,979,577 A 12/1990 Walter
4,981,184 A 1/1991 Knowlton et al.
4,991,667 A * 2/1991 Wilkes et al. ..... 175/61
4,991,670 A 2/1991 Fuller
5,009,273 A 4/1991 Grabinski
5,027,914 A 7/1991 Wilson
5,038,873 A 8/1991 Jurgens
5,052,503 A 10/1991 Lof
5,088,568 A 2/1992 Simuni
5,094,304 A 3/1992 Briggs
5,099,927 A 3/1992 Gibson et al.
5,103,919 A 4/1992 Warren
5,119,892 A 6/1992 Clegg et al.
5,135,060 A 8/1992 Ide
5,141,063 A 8/1992 Quesenbury
5,148,875 A 9/1992 Karlsson et al.
5,163,520 A 11/1992 Gibson
5,176,212 A 1/1993 Tandberg
5,186,268 A 2/1993 Clegg
5,222,566 A 6/1993 Taylor
5,255,749 A 10/1993 Bumpurs
5,259,469 A 11/1993 Stjernstrom
5,265,682 A 11/1993 Russell
5,311,953 A 5/1994 Walker
5,314,030 A * 5/1994 Peterson et al. ..... 175/26
5,361,859 A 11/1994 Tibbitts
5,388,649 A 2/1995 Ilomaki
5,410,303 A 4/1995 Comeau et al.
5,415,030 A 5/1995 Jogi
5,417,292 A 5/1995 Polakoff
5,423,389 A 6/1995 Warren
5,443,128 A 8/1995 Amaudric du Chaffaut
5,475,309 A 12/1995 Hong
5,507,357 A 4/1996 Hult
5,553,678 A * 9/1996 Barr et al. ..... 175/73
5,560,440 A 10/1996 Tibbitts
5,568,838 A 10/1996 Struthers
5,642,782 A 7/1997 Grimshaw
5,655,614 A 8/1997 Azar
5,678,644 A 10/1997 Fielder
5,720,355 A 2/1998 Lamine et al.
5,732,784 A 3/1998 Nelson
5,758,731 A 6/1998 Zollinger
5,758,732 A 6/1998 Liw
5,778,991 A 7/1998 Runquist et al.
5,794,728 A 8/1998 Palmberg
5,806,611 A 9/1998 Van Den Steen et al.
5,833,021 A 11/1998 Mensa-Wilmot
5,864,058 A 1/1999 Chen
5,896,938 A 4/1999 Moeny et al.
5,901,113 A 5/1999 Masak
5,901,796 A 5/1999 McDonald
5,904,444 A 5/1999 Kabeuchi et al.
5,924,499 A 7/1999 Birchak et al.
5,947,215 A 9/1999 Lundell
5,950,743 A 9/1999 Cox
5,957,223 A 9/1999 Doster et al.
5,957,225 A 9/1999 Sinor
5,967,247 A 10/1999 Pessier
5,979,571 A 11/1999 Scott et al.
5,992,547 A 11/1999 Caraway et al.
5,992,548 A 11/1999 Silva et al.
6,021,859 A 2/2000 Tibbitts et al.
6,039,131 A 3/2000 Beaton
6,047,239 A 4/2000 Berger et al.
6,050,350 A 4/2000 Morris et al.
6,089,332 A * 7/2000 Barr et al. ..... 175/45
6,092,610 A 7/2000 Kosmala et al.
6,131,675 A 10/2000 Anderson
6,150,822 A 11/2000 Hong et al.
6,161,631 A 12/2000 Kennedy et al.
6,186,251 B1 2/2001 Butcher
6,202,761 B1 3/2001 Forney
6,213,225 B1 4/2001 Chen
6,213,226 B1 4/2001 Eppink et al.
6,223,824 B1 5/2001 Moyes
6,269,893 B1 8/2001 Beaton
6,296,069 B1 10/2001 Lamine
6,298,930 B1 10/2001 Sinor et al.
6,321,858 B1 11/2001 Wentworth et al.
6,340,064 B2 1/2002 Fielder
6,363,780 B1 4/2002 Rey-Fabret et al.
6,364,034 B1 4/2002 Schoeffler
6,364,038 B1 4/2002 Driver
6,394,200 B1 5/2002 Watson
6,439,326 B1 8/2002 Huang
6,443,249 B2 9/2002 Beuershausen et al.
6,450,269 B1 9/2002 Wentworth et al.
6,454,030 B1 9/2002 Findley et al.
6,466,513 B1 10/2002 Pabon
6,467,341 B1 10/2002 Boucher et al.
6,474,425 B1 11/2002 Truax
6,484,819 B1 11/2002 Harrison
6,484,825 B2 11/2002 Watson
6,502,650 B1 1/2003 Beccu
6,510,906 B1 1/2003 Richert et al.
6,513,606 B1 2/2003 Krueger
6,533,050 B2 3/2003 Molloy
6,575,236 B1 6/2003 Heijnen
6,581,699 B1 6/2003 Chen et al.
6,588,518 B2 7/2003 Eddison
6,594,881 B2 7/2003 Tibbitts
6,601,454 B1 8/2003 Botnan
6,601,662 B2 8/2003 Matthias et al.
6,622,803 B2 9/2003 Harvey et al.
6,668,949 B1 12/2003 Rives
6,670,880 B1 12/2003 Hall et al.
6,698,537 B2 3/2004 Pascale
6,729,420 B2 5/2004 Mensa-Wilmot
6,732,817 B2 5/2004 Dewey
6,749,031 B2 6/2004 Klemm
6,789,635 B2 9/2004 Wentworth et al.
6,814,162 B2 11/2004 Moran
6,820,697 B1 11/2004 Churchill
6,822,579 B2 11/2004 Goswami et al.
6,880,648 B2 4/2005 Edscer
6,913,095 B2 7/2005 Krueger
6,929,076 B2 8/2005 Fanuel et al.
6,948,572 B2 9/2005 Hay et al.
6,953,096 B2 10/2005 Gledhill et al.
6,994,175 B2 2/2006 Egerstrom
7,013,994 B2 3/2006 Eddison
7,025,155 B1 4/2006 Estes
7,073,610 B2 7/2006 Susman
7,096,980 B2 8/2006 Trevas
7,104,344 B2 9/2006 Kriesels
7,198,119 B1 4/2007 Hall et al.
7,204,560 B2 4/2007 Mercier et al.
7,207,398 B2 4/2007 Runia
7,225,886 B1 6/2007 Hall
7,240,744 B1 7/2007 Kemick

| | | | |
|---|---|---|---|
| 7,270,196 | B2 | 9/2007 | Hall |
| 7,328,755 | B2 | 2/2008 | Hall et al. |
| 7,337,858 | B2 | 3/2008 | Hall et al. |
| D566,137 | S | 4/2008 | Hall et al. |
| 7,360,610 | B2 | 4/2008 | Hall et al. |
| 7,360,612 | B2 | 4/2008 | Chen et al. |
| 7,367,397 | B2 | 5/2008 | Clemens et al. |
| 572,735 | A1 | 7/2008 | Kammerer |
| 7,398,837 | B2 | 7/2008 | Hall et al. |
| 7,419,016 | B2 | 9/2008 | Hall et al. |
| 7,419,018 | B2 | 9/2008 | Hall et al. |
| 7,424,922 | B2 | 9/2008 | Hall et al. |
| 7,426,968 | B2 | 9/2008 | Hall et al. |
| 7,481,281 | B2 | 1/2009 | Schuaf |
| 7,484,576 | B2 | 2/2009 | Hall et al. |
| 7,497,279 | B2 | 3/2009 | Hall et al. |
| 7,503,405 | B2 | 3/2009 | Hall et al. |
| 7,506,701 | B2 | 3/2009 | Hall et al. |
| 7,510,031 | B2 | 3/2009 | Russell et al. |
| 7,549,489 | B2 | 6/2009 | Hall et al. |
| 7,559,379 | B2 | 7/2009 | Hall et al. |
| 7,571,780 | B2 | 8/2009 | Hall et al. |
| 7,600,586 | B2 | 10/2009 | Hall et al. |
| 7,617,886 | B2 | 11/2009 | Hall |
| 7,624,824 | B2 | 12/2009 | Hall et al. |
| 7,641,003 | B2 | 1/2010 | Hall et al. |
| 7,694,756 | B2 | 4/2010 | Hall et al. |
| 2001/0054515 | A1 | 12/2001 | Eddison et al. |
| 2002/0050359 | A1 | 5/2002 | Eddison |
| 2003/0213621 | A1 | 11/2003 | Britten |
| 2004/0154839 | A1 | 8/2004 | McGarian et al. |
| 2004/0222024 | A1 | 11/2004 | Edscer |
| 2004/0238221 | A1 | 12/2004 | Runia |
| 2004/0256155 | A1 | 12/2004 | Kriesels |

OTHER PUBLICATIONS

PCT Written Opinion of the International Searching Authority for PCT/US07/64544, mailed Sep. 24, 2008.

PCT Written Opinion of the International Searching Authority for PCT/US06/43107, mailed May 21, 2008.

PCT International Preliminary Report on Patentability Chapter 1 for PCT/US06/43107, mailed May 27, 2008.

PCT Written Opinion of the International Searching Authority for PCT/US06/43125, mailed May 21, 2008.

PCT International Preliminary Report on Patentability Chapter 1 for PCT/US06/43125, mailed May 27, 2008.

* cited by examiner

DOWNHOLE PERCUSSIVE TOOL WITH ALTERNATING PRESSURE DIFFERENTIALS

CROSS REFERENCE TO RELATED APPLICATIONS

This patent application is a continuation-in-part of U.S. patent application Ser. No. 12/178,467 filed on Jul. 23, 2008 now U.S. Pat. No. 7,730,975 issued on Jun. 8, 2010, which is a continuation-in-part of U.S. patent application Ser. No. 12/039,608 filed on Feb. 28, 2008 and is now U.S. Pat. No. 7,762,353 issued on Jul. 27, 2010, which is a continuation-in-part of U.S. patent application Ser. No. 12/037,682 filed on Feb. 26, 2008 and now U.S. Pat. No. 7,624,824 issued on Dec. 1, 2009, which is a continuation-in-part of U.S. patent application Ser. No. 12/019,782 filed on Jan. 25, 2008 and now U.S. Pat. No. 7,617,886 issued on Nov. 17, 2009, which is a continuation-in-part of U.S. patent application Ser. No. 11/837,321 filed on Aug. 10, 2007 and now U.S. Pat. No. 7,559,379 issued on Jul. 14, 2009, which is a continuation-in-part of U.S. patent application Ser. No. 11/750,700 filed on May 18, 2007 and now U.S. Pat. No. 7,549,489 issued on Jun. 23, 2009, which is a continuation-in-part of U.S. patent application Ser. No. 11/737,034 filed on Apr. 18, 2007 and now U.S. Pat. No. 7,503,405 issued on Mar. 17, 2009, which is a continuation-in-part of U.S. patent application Ser. No. 11/686,638 filed on Mar. 15, 2007 and now U.S. Pat. No. 7,424,922 issued on Sep. 16, 2008, which is a continuation-in-part of U.S. patent application Ser. No. 11/680,997 filed on Mar. 1, 2007 and now U.S. Pat. No. 7,419,016 issued on Sep. 2, 2008, which is a continuation-in-part of U.S. patent application Ser. No. 11/673,872 filed on Feb. 12, 2007 and now U.S. Pat. No. 7,484,576 issued on Feb. 3, 2009, which is a continuation-in-part of U.S. patent application Ser. No. 11/611,310 filed on Dec. 15, 2006 and now U.S. Pat. No. 7,600,586 issued on Oct. 13, 2009.

U.S. patent application Ser. No. 12/178,467 is also a continuation-in-part of U.S. patent application Ser. No. 11/278,935 filed on Apr. 6, 2006 and now U.S. Pat. No. 7,426,968 issued on Sep. 23, 2008, which is a continuation-in-part of U.S. patent application Ser. No. 11/277,394 filed on Mar. 24, 2006 and now U.S. Pat. No. 7,398,837 issued on Jul. 15, 2008, which is a continuation-in-part of U.S. patent application Ser. No. 11/277,380 filed on Mar. 24, 2006 and now U.S. Pat. No. 7,337,858 issued on Mar. 4, 2008, which is a continuation-in-part of U.S. patent application Ser. No. 11/306,976 filed on Jan. 18, 2006 and now U.S. Pat. No. 7,360,610 issued on Apr. 22, 2008, which is a continuation-in-part of U.S. patent application Ser. No. 11/306,307 filed on Dec. 22, 2005 and now U.S. Pat. No. 7,225,886 issued on Jun. 5, 2007, which is a continuation-in-part of U.S. patent application Ser. No. 11/306,022 filed on Dec. 14, 2005 and now U.S. Pat. No. 7,198,119 issued on Apr. 3, 2007, which is a continuation-in-part of U.S. patent application Ser. No. 11/164,391 filed on Nov. 21, 2005 and now U.S. Pat. No. 7,270,196 issued on Sep. 18, 2007.

U.S. patent application Ser. No. 12/178,467 is also a continuation-in-part of U.S. patent application Ser. No. 11/555,334 filed on Nov. 1, 2006 and now U.S. Pat. No. 7,419,018 issued on Sep. 2, 2008.

All of these applications are herein incorporated by reference in their entirety.

BACKGROUND

The present invention relates to the field of oil, gas and/or geothermal exploration and more particularly to the field of percussive tools used in down hole drilling. More specifically, the invention relates to the field of downhole jack hammers and vibrators which may be actuated by drilling fluid or mud.

Percussive jack hammers are known in the art and may be placed at the end of a bottom hole assembly (BHA). At that location they act to effectively apply drilling power to a formation, thus aiding penetration into the formation.

U.S. Pat. No. 7,424,922 to Hall, et al., which is herein incorporated by reference for all that it contains, discloses a jack element that is housed within a bore of a tool string and that has a distal end extending beyond a working face of the tool string. A rotary valve is disposed within the bore of the tool string. The rotary valve has a first disc attached to a driving mechanism and a second disc axially aligned with and contacting the first disc along a flat surface. As the discs rotate relative to one another at least one port formed in the first disc aligns with another port formed in the second disc. Fluid passing through the aligned ports displaces an element in mechanical communication with a jack element.

Percussive vibrators are also known in the art and may be placed anywhere along the length of the drill string. Such vibrators act to shake the drill string loose when it becomes stuck against the earthen formation or to help the drill string move along when it is laying substantially on its side in a nonvertical formation. Vibrators may also be used to compact a gravel packing or cement lining by vibration, or to fish a stuck drill string or other tubulars, such as production liners or casing strings, gravel pack screens, etc., from a bore hole.

U.S. Pat. No. 4,890,682 to Worrall, et al., which is herein incorporated by reference for all that it contains, discloses a jarring apparatus provided for vibrating a pipe string in a borehole. The jarring apparatus generates, at a downhole location, longitudinal vibrations in the pipe string in response to a flow of fluid through the interior of said pipe string.

U.S. Pat. No. 7,419,018 to Hall, et al., which is herein incorporated by reference for all that it contains, discloses a downhole drill string component which has a shaft being axially fixed at a first location to an inner surface of an opening in a tubular body. A mechanism is axially fixed to the inner surface of the opening at a second location and is in mechanical communication with the shaft. The mechanism is adapted to elastically change a length of the shaft and is in communication with a power source. When the mechanism is energized, the length is elastically changed.

Not withstanding the preceding patents regarding downhole jack hammers and vibrators, there remains a need in the art for more powerful mud actuated downhole tools. There is also a need in the art for means to easily adjust the force of the downhole tool. Thus, further advancements in the art are needed.

SUMMARY

In one aspect of the present invention a downhole tool string includes a downhole percussive tool. The downhole percussive tool has an interior chamber with a piston element that divides the interior chamber into two pressure chambers. The piston element may slide back and forth within the interior chamber thus altering the volumes of the two pressure chambers. The percussive tool also has input channels that lead drilling fluid into the interior chamber or bypass the interior chamber and continue along the downhole tool string. The downhole percussive tool additionally has exit orifices that release drilling fluid from the interior chamber and take drilling fluid directly from the input channels and send it along the downhole tool string. Furthermore, the percussive tool has exhaust orifices that release drilling fluid from the interior chamber.

The present invention includes a rotary valve that is actively driven by a driving mechanism. The driving mechanism may be a turbine, a motor, or another suitable means known in the art. The rotary valve comprises two discs that face each other along a surface. Both discs have ports formed therein that may align or misalign as the discs rotate relative to one another. The discs may be formed of material selected from the group consisting of steel, chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, and silicon bounded diamond, and.

In a first stroke of the piston element, the two discs rotate relative to one another and at least two misalign to block the flow of drilling fluid to a first group of input channels. At the same moment, at least two other ports align to allow a second group of input channels to feed drilling fluid into a first pressure chamber on one side of the interior chamber and also out through exit orifices. The flow of drilling fluid into the first pressure chamber causes the pressure to rise in that chamber and forces the piston element to move towards a second pressure chamber. Drilling fluid in the second pressure chamber is forced out through exit orifices or through exhaust orifices. The combined area of the exit orifices and exhaust orifices through which the drilling fluid in the second pressure chamber is being released may be larger than the combined area of the exit orifices through which the drilling fluid from the second group of input channels is flowing, thus causing the pressure to be greater in the first pressure chamber than in the second pressure chamber.

In a second stroke of the piston element, the two discs rotate further relative to one another, thus aligning the at least two ports and allowing the first group of input channels to supply drilling fluid into the second pressure chamber and also out through exit orifices. The at least two other ports also misalign to block the flow of drilling fluid to the second group of input channels. The increased pressure from the drilling mud in the second pressure chamber forces the piston element to move back toward the first pressure chamber. The drilling fluid in the first pressure chamber under lower pressure is forced out of exit orifices or through exhaust orifices. The combined area of the exit orifices and exhaust orifices through which the drilling fluid in the first pressure chamber is being released may be larger than the combined area of the exit orifices through which the drilling fluid from the first group of input channels is flowing, thus causing the pressure to be greater in the second pressure chamber than in the first pressure chamber.

Since the pressure differential between the first pressure chamber and the second pressure chamber is primarily a function of the difference in areas of the exit orifices and exhaust orifices dedicated to each, then that pressure differential may be easily adjusted by regulating the size of the orifices used rather than changing the internal geometry of the rotary valve.

In one embodiment of the present invention, the percussive tool acts as a jack hammer. In this embodiment, the percussive tool includes a jack element that is partially housed within a bore of the drill string and has a distal end extending beyond the working face of the tool string. The back-and-forth motion of the piston element causes the jack element to apply cyclical force to the earthen formation surrounding the drill string at the working face of the tool string. This generally aids the drill string in penetrating through the formation. In this embodiment, the exit orifices and exhaust orifices are formed as nozzles that spray drilling fluid out of the working face of the tool string and also generally allow the drill string to move faster through the formation.

In another embodiment of the present invention, the percussive tool acts as a vibrator. In this embodiment, the percussive tool may be located at any location along the drill string and shakes the drill string as the piston element moves back and forth. The piston element may be weighted sufficiently to shake the drill string or an additional weight may be partially housed within the drill string that acts to shake the drill string.

DETAILED DESCRIPTION

Figure 1:
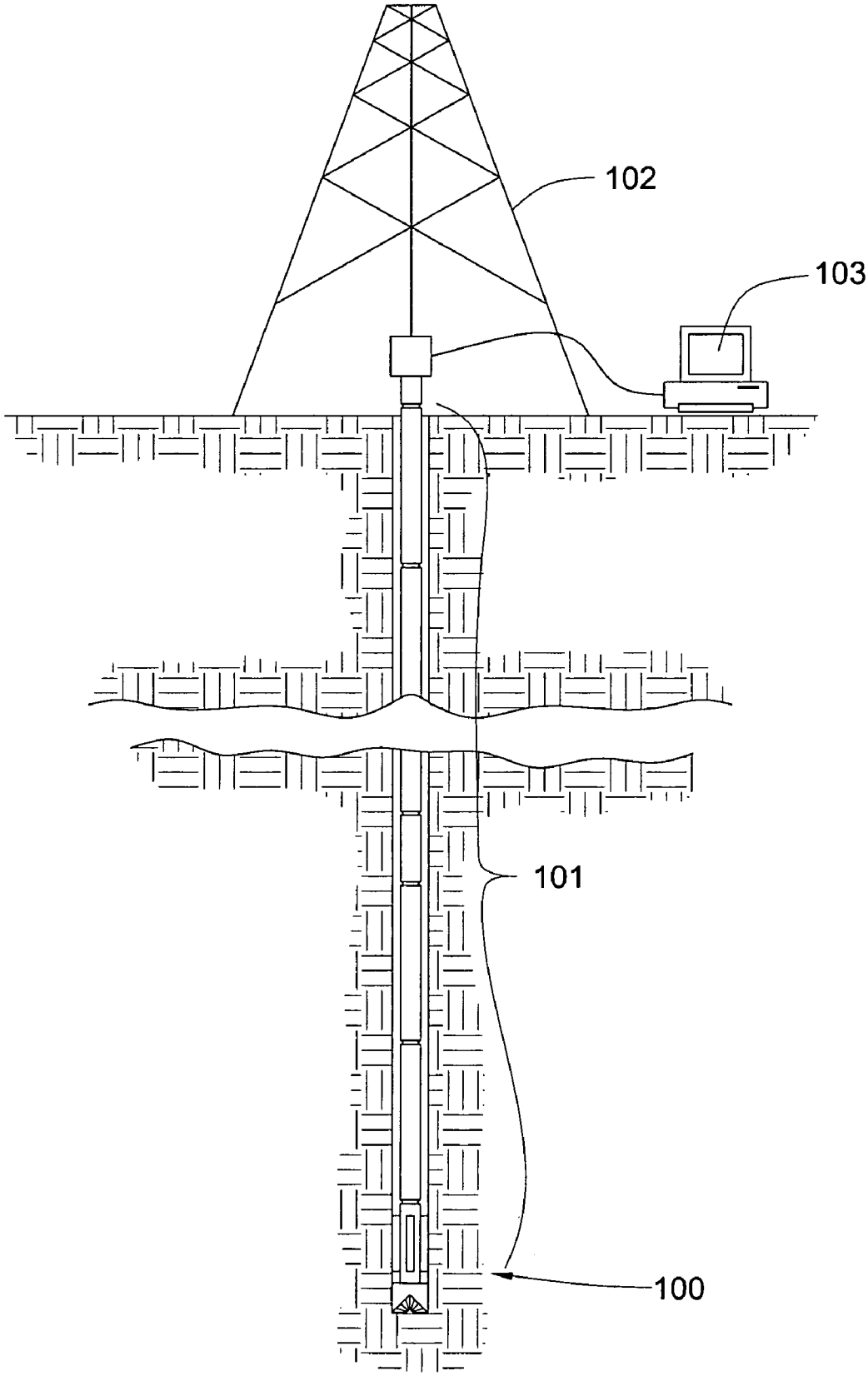
FIG. 1 is a side-view diagram of an embodiment of a downhole tool string assembly in a cut away view of a formation.

Referring now to FIG. 1, a downhole drill string 101 may be suspended by a derrick 102. The downhole drill string 101 may comprise one or more downhole drill string tools 100, linked together in the downhole drill string 101 and in communication with surface equipment 103 through a downhole network.

Figure 2:
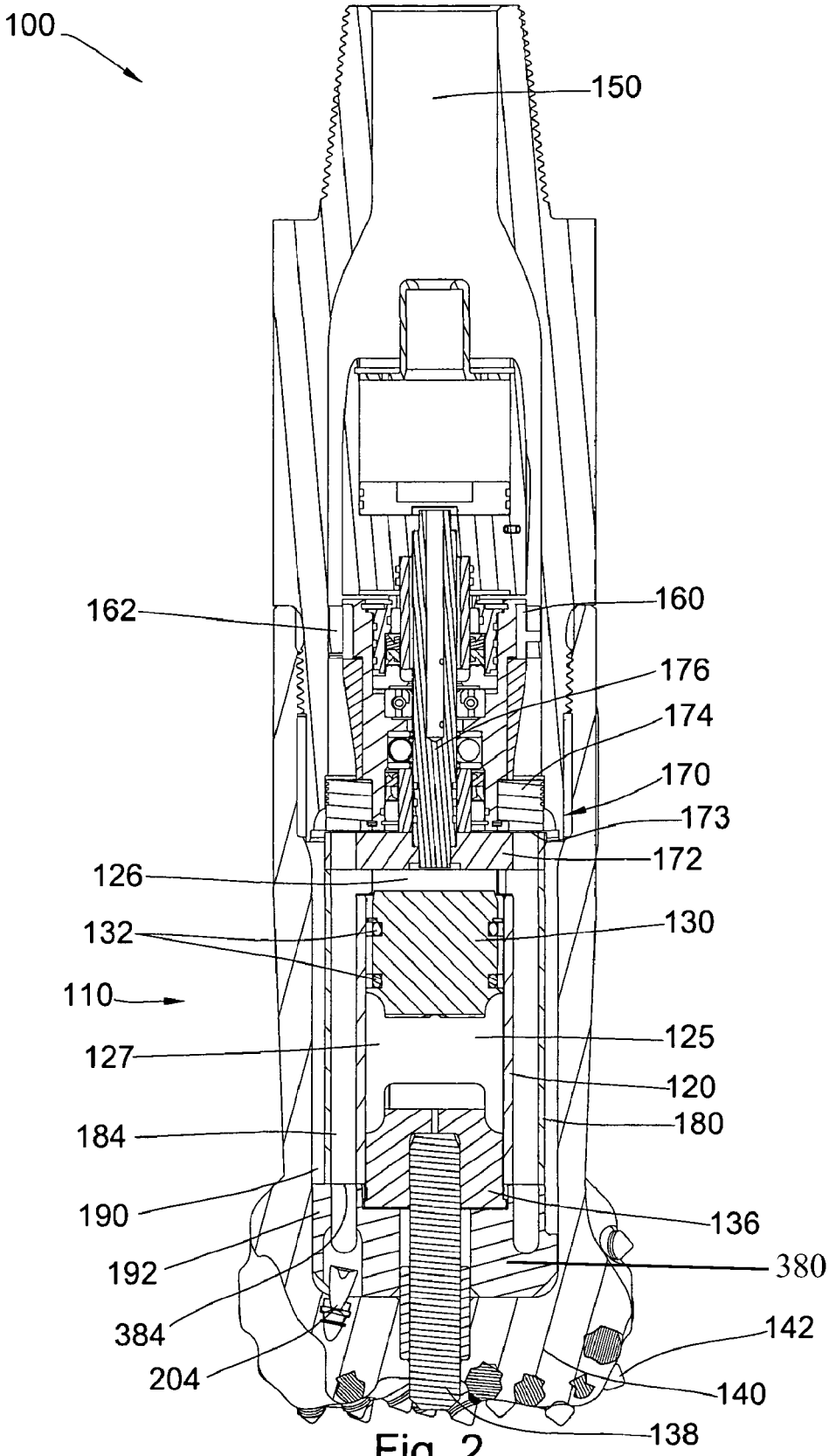
FIG. 2 is a cross-sectional diagram of an embodiment of a downhole percussive tool.

FIG. 2 shows a cross-sectional diagram of an embodiment of a downhole drill string tool 100A. This embodiment of a downhole drill string tool 100A includes a percussive tool 110. The percussive tool 110 has an inner cylinder 120 that defines an interior chamber 125. The percussive tool 110 also has an outer cylinder 180 which may have multiple internal flutes 182 (see FIG. 3*a*). The outer cylinder 180 substantially surrounds the internal cylinder 120 and the internal flutes 182 may be in contact with the internal cylinder 120 thus forming multiple input channels 184 and 186. (See FIG. 3*a*)

A piston element 130 sits within the interior chamber 125 and divides the interior chamber 125 into a first pressure chamber 126 and a second pressure chamber 127. The piston element 130 may slide back and forth within the interior chamber 125 thus altering the respective volumes of the first pressure chamber 126 and the second pressure chamber 127. The volume of the first pressure chamber 126 may be inversely related to the volume of the second pressure chamber 127. The piston element 130 has seals 132 which may prevent drilling fluid from passing between the first pressure chamber 126 and the second pressure chamber 127.

The drill string 101 has a center bore 150 through which drilling fluid may flow downhole. At the percussive tool 110, the center bore 150 may be separated thus allowing the drilling fluid to flow past a turbine 160 which has multiple turbine blades 162. In this embodiment, the turbine 160 acts as a driving mechanism to drive a rotary valve 170. In other embodiments, the driving mechanism may be a motor or another suitable means known in the art.

The rotary valve 170 comprises a first disc 174 which is attached to the driving mechanism, the turbine 160 in this embodiment, and a second disc 172 which is axially aligned with the first disc 174 by means of an axial shaft 176. The second disc 172 also faces the first disc 174 along a surface 173. The first disc 174 and the second disc 172 may comprise materials selected from the group consisting of steel, chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded, and diamond. A superhard material such as diamond or cubic boron nitride may line internal edges 371 (see FIG. 3*e*)of the first disc 174 and second disc 172 to increase resistance to abrasion. The superhard material may be sintered, inserted, coated, or vapor deposited.

The first disc 174 may have through ports 370 and exhaust ports 372. (See FIG. 3*f*) The second disc 172 may have first ports 374 and second ports 376. (See FIG. 3*e*) As drilling fluid flows down the center bore 150 and passes by the turbine blades 162 it causes the turbine 160 to rotate and drive the first disc 174. The first disc then rotates relative to the second disc.

In a first stroke of the piston element 130, as the first and second discs 174 and 172 rotate relative to one another, the through ports 370 of the first disc 174 align with the second ports 376 of the second disc 172. This allows drilling fluid to flow into the second input channels 186. From the second input channel a portion of the fluid flows into the first pressure chamber 126 and a portion of the fluid flows down the second input channels 186 and out a second exit orifice 386. (See FIGS. 3*g* and 3*h*) Also, during the first stroke the exhaust ports 372 of the first disc 174 align with the first ports 374 of the second disc 172. This allows drilling fluid within the second pressure chamber 127 to escape to the first input channels 184 and either flow out first exit orifices 384 or flow out exhaust channel 190 to exhaust orifices 192.

In a second stroke of the piston element 130, as the first and second discs 174 and 172 rotate further relative to one another, the through ports 370 of the first disc 174 align with the first ports 374 of the second disc 172. This allows drilling fluid to flow into the first input channels 184. From the first input channels a portion of the fluid flows into the second pressure chamber 127 and another portion of the fluid flows down the first input channels 184 and out the first exit orifice 384. (See FIGS. 3*g* and 3*h*) Also during the second stroke the exhaust ports 372 of the first disc 174 align with the second ports 376 of the second disc 172. This allows drilling fluid within the first pressure chamber 126 to escape to the second input channels 186 and either flow out second exit orifices 386 or flow out exhaust channel 190 to exhaust orifices 192.

The drilling fluid may be drilling mud traveling down the drill string or hydraulic fluid isolated from the downhole drilling mud and circulated by a downhole motor. In various embodiments, the ports may be alternately opened electronically.

In the embodiment shown in FIG. 2, the first exit orifices 384 includes first exit nozzles 204, the second exit orifices 386 includes second exit nozzles 206, and the exhaust orifices 192 includes exhaust nozzles 209. (See FIG. 4)

The first exit nozzles 204, second exit nozzles 206, and exhaust nozzles 209 may be located on a drill bit 140. The drill bit 140 may have a plurality of cutting elements 142. The cutting elements 142 may comprise a superhard material such as diamond, polycrystalline diamond, or cubic boron nitride. The drill bit 140 may rotate around a jack element 138 which protrudes from the drill bit 140. The jack element 138 may be in contact with an impact element 136. In operation, as the piston element 130 slides within the inner cylinder 120 it may impact the impact element 136 which may force the jack element 138 to protrude farther from the drill bit 140 with repeated thrusts. It is believed that these repeated thrusts may aid the drill bit 140 in drilling through earthen formations. The jack element 138 may also have an angled end that may help steer the drill bit 140 through earthen formations.

One of the advantages of this embodiment is that if the first exit nozzles 204 and second exit nozzles 206 are similar in discharge area then the pressure in the first pressure chamber 126 is greater than the pressure in the second pressure chamber 127 during the first stroke and the reverse is true during the second stoke. This is true because the discharge area of the exhaust nozzles 209 added to the discharge area of the exit nozzles from which the drilling fluid is escaping will always be greater than the discharge area of the exit nozzles from which the drill fluid is not escaping. Another believed advantage of this embodiment is that the pressure differential between the first pressure chamber 126 and the second pressure chamber 127 may be able to be adjusted by adjusting the discharge area of the exhaust nozzle 209.

Referring now to FIGS. 3*a-j*, which are perspective diagrams of several components of the embodiment shown in FIG. 2.

Figure 3A:
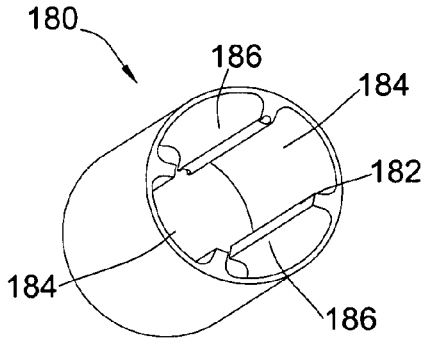
FIGS. 3*a-j* are perspective diagrams of several components of an embodiment of a downhole percussive tool.

FIG. 3*a* is a perspective diagram of an embodiment of the outer cylinder 180. As described earlier, outer cylinder 180 may have multiple internal flutes 182. The internal flutes 182 may be in contact with the internal cylinder 120 (see FIG. 3*b*) thus forming multiple input channels 184 and 186. The first input channels 184 may be aligned with second openings 324 (see FIG. 3*b*) to the second pressure chamber 127 thus allowing drilling fluid to flow into and out of the second pressure chamber 127. The second input channels 186 may be aligned with first openings 326 (see FIG. 3*b*) to the first pressure chamber 126 thus allowing drilling fluid to flow into and out of the first pressure chamber 126.

Figure 3B:
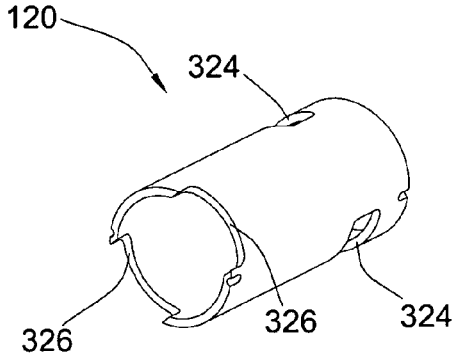

FIG. 3*b* is a perspective diagram of an embodiment of the inner cylinder 120. The inner cylinder 120 may have first openings 326 and second openings 324.

Figure 3C:
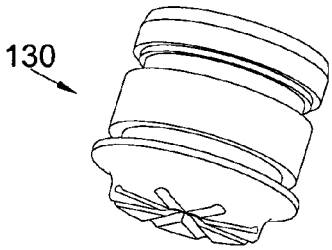

FIG. 3*c* is a perspective diagram of an embodiment of the piston element 130. The piston element 130 sits within the inner cylinder 120 (see FIG. 3*b*) and separates the inner cylinder into the first pressure chamber 126 and second pressure chamber 127. (See FIG. 2) In operation, the piston element 130 may impact the impact element 136. (See FIG. 3*d*).

Figure 3D:
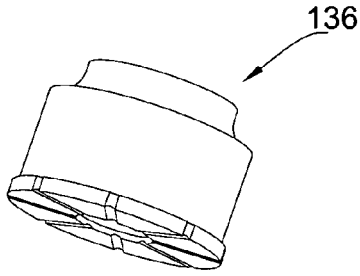

FIG. 3*d* is a perspective diagram of an embodiment of the impact element 136. It is believed that the force of the piston element 130 (see FIG. 3*c*) impacting the impact element 136 may apply repetitive force to the jack element 138 (see FIG. 3*i*) thus aiding in the breaking up of earthen formations.

Figure 3E:
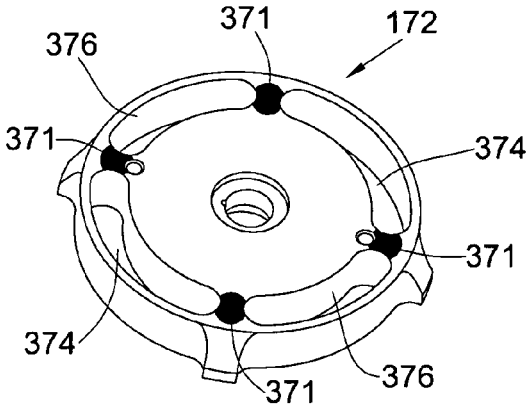

FIG. 3*e* is a perspective diagram of an embodiment of a second disc 172 which may form part of rotary valve 170. (See FIG. 2) Second disc 172 may include first ports 374 and second ports 376.

Figure 3F:
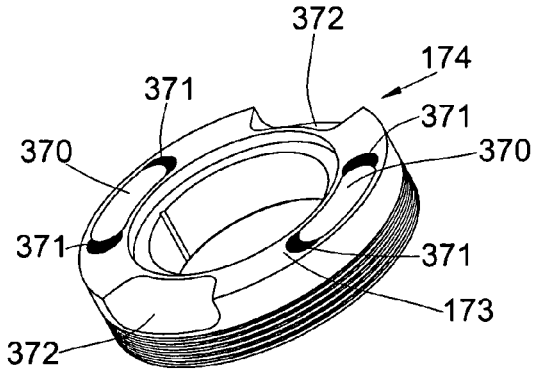

FIG. 3*f* is a perspective diagram of an embodiment of a first disc 174 which may form another part of rotary valve 170. (See FIG. 2) First disc 174 may have through ports 370 and exhaust ports 372. The first disc 174 may face the second disc 172 (see FIG. 3*e*) along a surface 173.

Figure 3G:
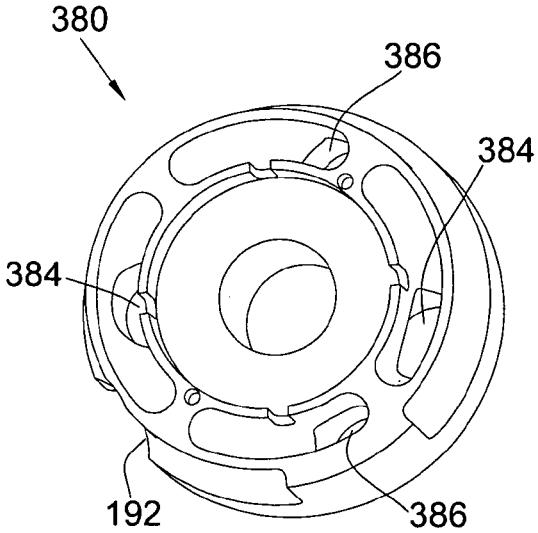
Figure 3H:
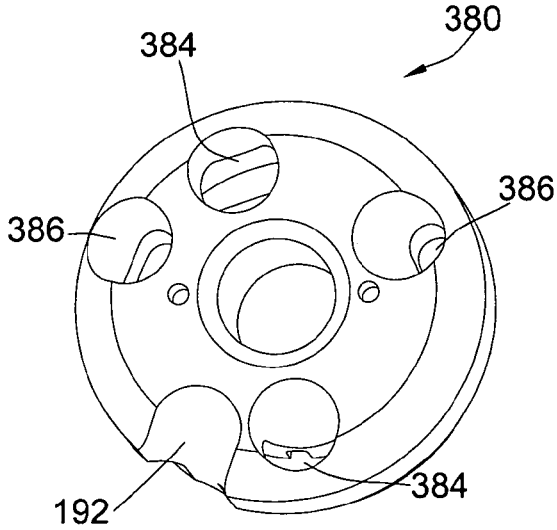

FIGS. 3*g* and 3*h* are perspective diagrams showing reverse sides of an embodiment of a flow plate 380. The flow plate 380 may have first exit orifices 384 and second exit orifices 386 which may conduct some of the flow from first input channels 184 and second input channels 186 respectively (see FIG. 2). Flow plate 380 may also have exhaust orifice 192 which may conduct some of the flow from exhaust channel 190 (see FIG. 2).

Figure 3I:
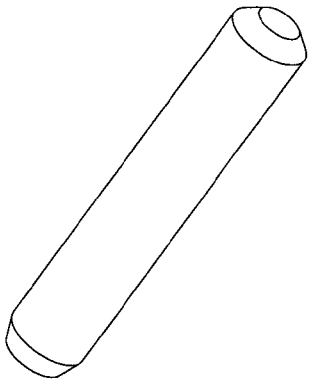

FIG. 3*i* is a perspective diagram of an embodiment of jack element 138. The jack element 138 may be formed of a material such as steel, chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix, silicon bounded diamond, and/or combinations thereof.

Figure 3J:
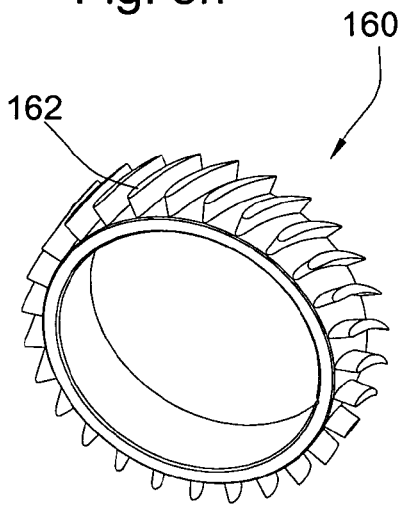

FIG. 3*j* is a perspective diagram of an embodiment of turbine 160. Turbine 160 may have a substantially circular geometry. Turbine 160 may also include multiple turbine blades 162. Turbine 160 may be adapted to rotate when drilling fluid flows past turbine blades 162.

Figure 4:
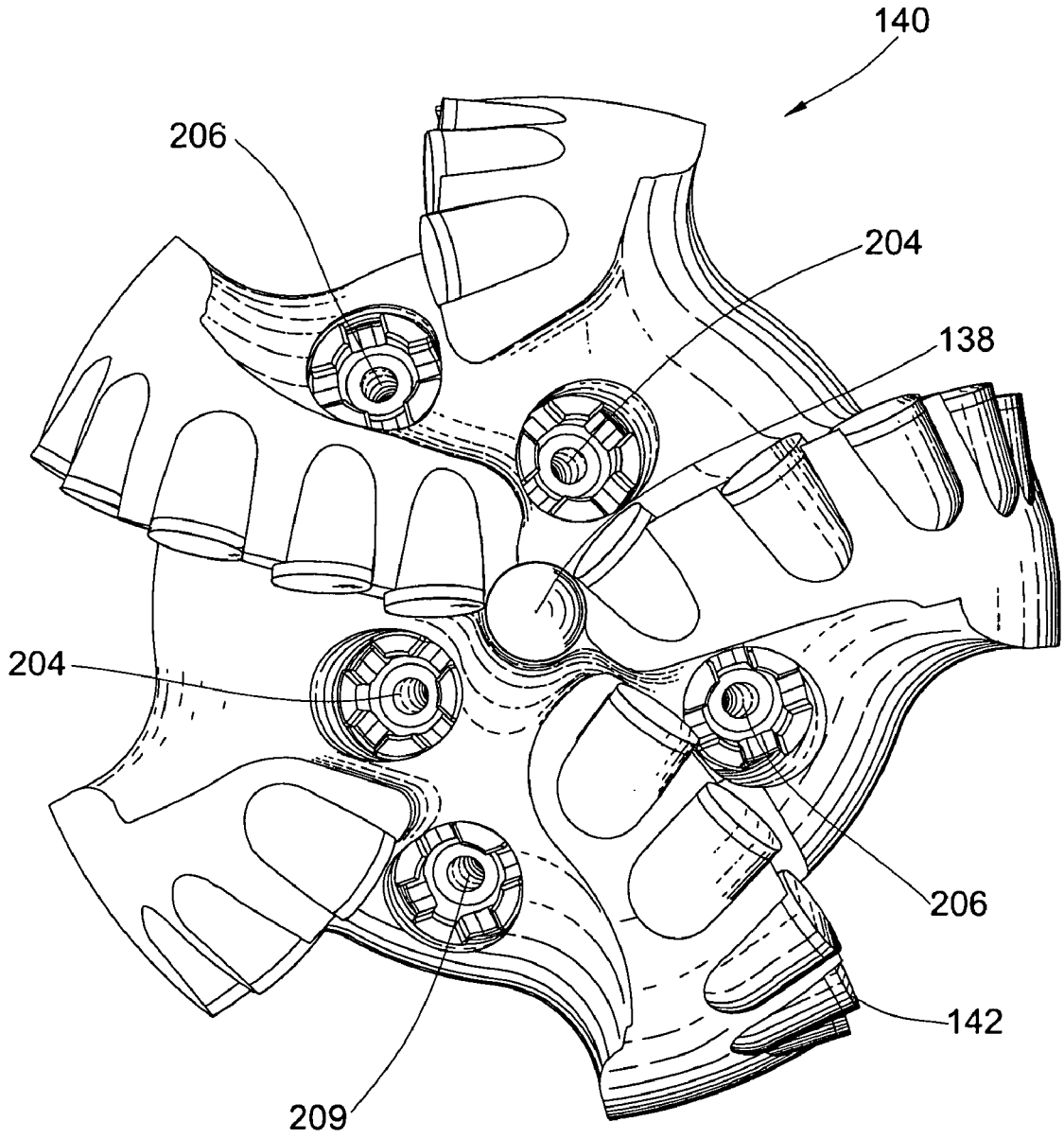
FIG. 4 is an axial diagram of an embodiment of a drill bit.

FIG. 4 is an axial diagram of an embodiment of a drill bit 140. Drill bit 140 may include first exit nozzles 204, second exit nozzles 206, and exhaust nozzles 209. Drill bit 140 may also include a plurality of cutting elements 142. Drill bit 140 may rotate around a jack element 138 which protrudes from the drill bit 140.

Figure 5:
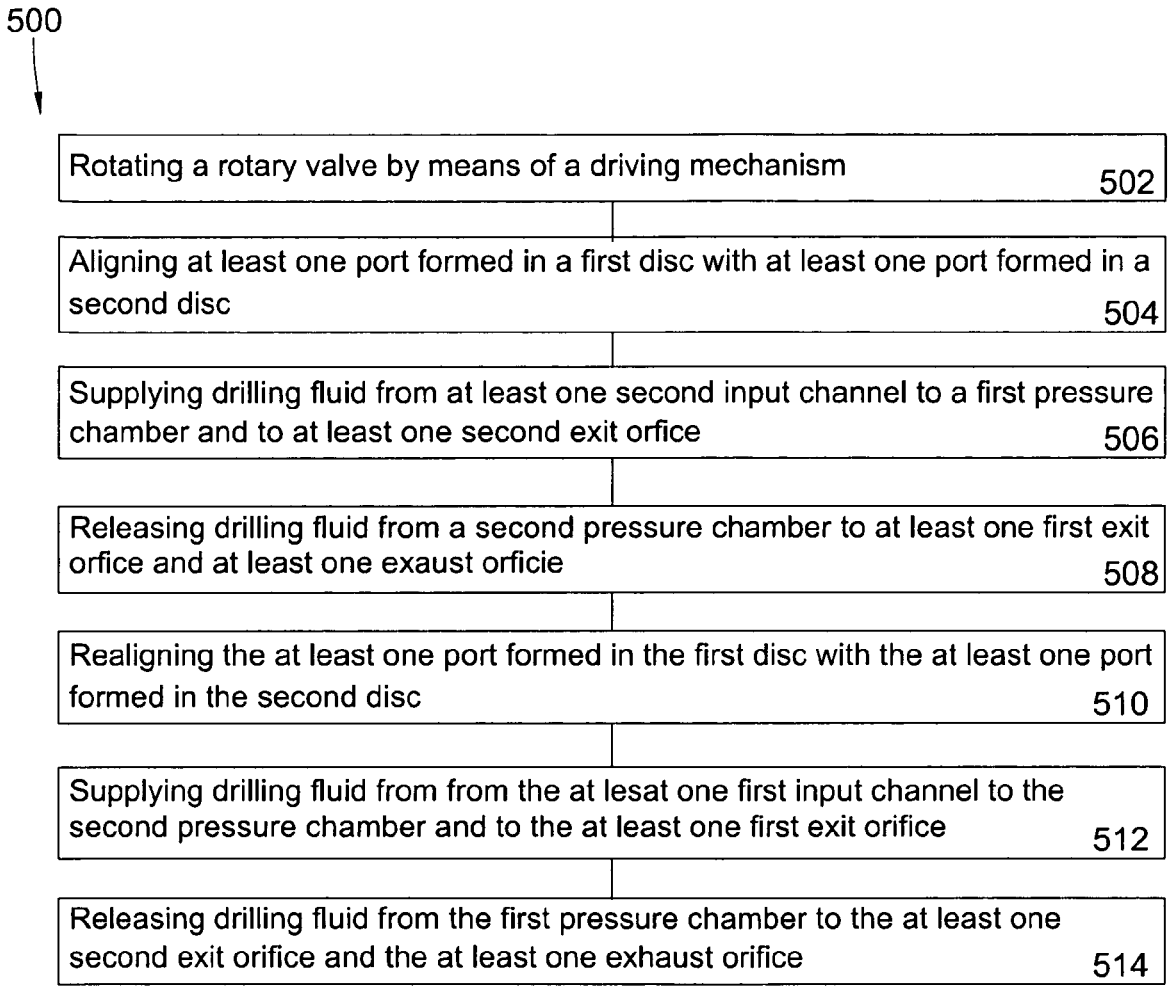
FIG. 5 is a flow diagram of an embodiment of a method of actuating a downhole drill string tool.

FIG. 5 is a flow diagram of an embodiment of a method of actuating a downhole drill string tool 500. Method 500 comprises the steps of rotating a rotary valve by means of a driving mechanism 502; aligning at least one port formed in a first disc with at least one port formed in a second disc 504; supplying drilling fluid from at least one second input channel to a first pressure chamber and to at least one second exit orifice 506; releasing drilling fluid from a second pressure chamber to at least one first exit orifice and at least one exhaust orifice 508; realigning the at least one port formed in the first disc with the at least one port formed in the second disc 510; supplying drilling fluid from the at least one first input channel to the second pressure chamber and to the at least one first exit orifice 512; and releasing drilling fluid from the first pressure chamber to the at least one second exit orifice and the at least one exhaust orifice 514. The rotating a rotary valve by means of a driving mechanism 502 may comprise passing drilling fluid past a turbine with multiple turbine blades which then rotates a rotary valve. The rotating 502 may also comprise rotating a motor or other driving means known in the art.

Figure 6A:
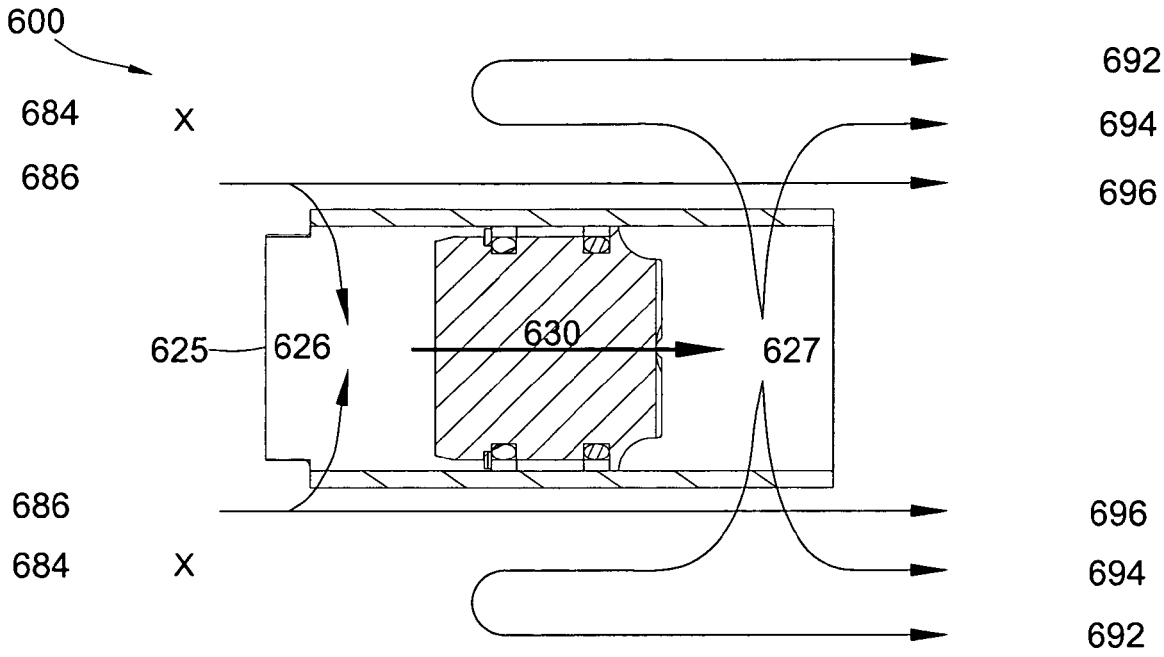
FIG. 6*a* is a representative drilling fluid flow diagram of an embodiment of a first stroke of a downhole drill string tool.
Figure 6B:
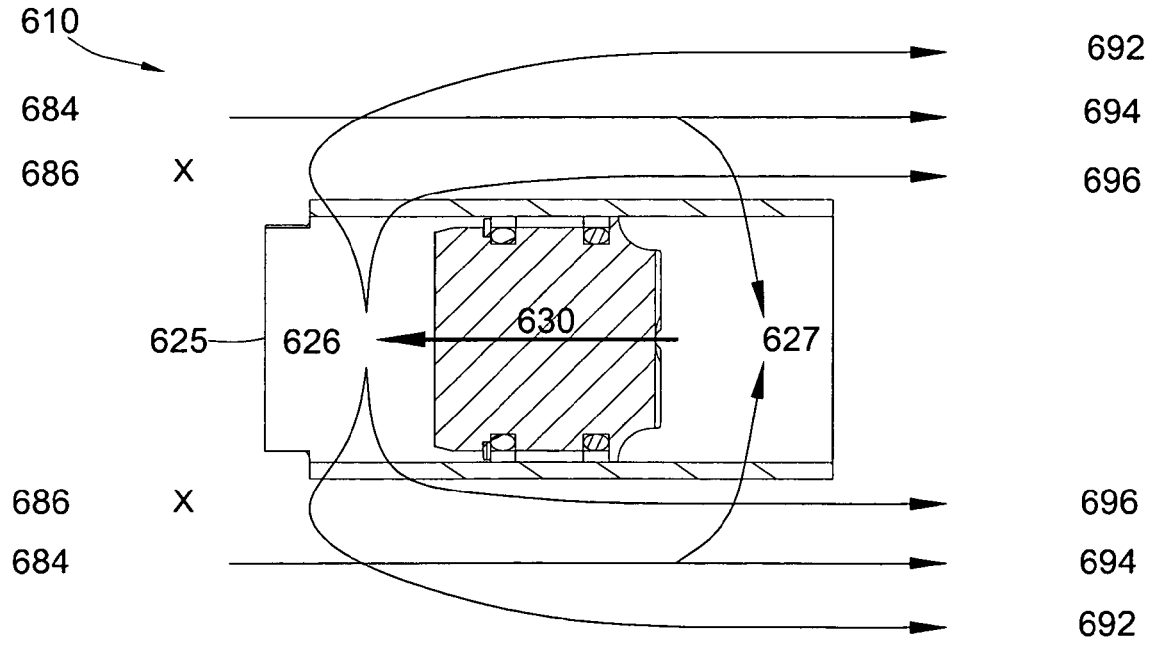
FIG. 6*b* is a representative drilling fluid flow diagram of an embodiment of a second stroke of a downhole drill string tool.

FIGS. 6*a* and 6*b* are drilling fluid flow diagrams representing embodiments of first and second strokes 600 and 610 respectively of a downhole drill string tool. FIG. 6*a* represents a piston element 630 sitting within an interior chamber 625 and dividing it into a first pressure chamber 626 and a second pressure chamber 627. During the first stroke 600, first input channels 684 are sealed, as indicated by the x next to the reference number, and second input channels 686 are open thus allowing drilling fluid to flow into first pressure chamber 626 and out a second exit orifice 696. Meanwhile, drilling fluid within second pressure chamber 627 is allowed to escape out of first exit orifice 694 and exhaust orifice 692. If the discharge areas of first exit orifice 694 and second exit orifice 696 are similar then the additional discharge area of the exhaust orifice 692 will cause the pressure in the first pressure chamber 626 to be greater than the pressure in the second pressure chamber 627 during the first stroke 600 causing the piston element 630 to move away from the first pressure chamber 626 and toward the second pressure chamber 627. The pressure differential between the first pressure chamber 626 and the second pressure chamber 627 will be able to be adjusted by adjusting the size of the exhaust orifice 692.

During second stroke 610, second input channels 686 are sealed, as indicated by the x next to the reference number, and first input channels 684 are open thus allowing drilling fluid to flow into second pressure chamber 627 and out a second exit orifice 696. Meanwhile, drilling fluid within first pressure chamber 626 is allowed to escape out of second exit orifice 696 and exhaust orifice 692. This will cause the pressure in the second pressure chamber 627 to be greater than the pressure in the first pressure chamber 626 causing the piston element 630 to move away from the second pressure chamber 627 and toward the first pressure chamber 626.

Figure 7:
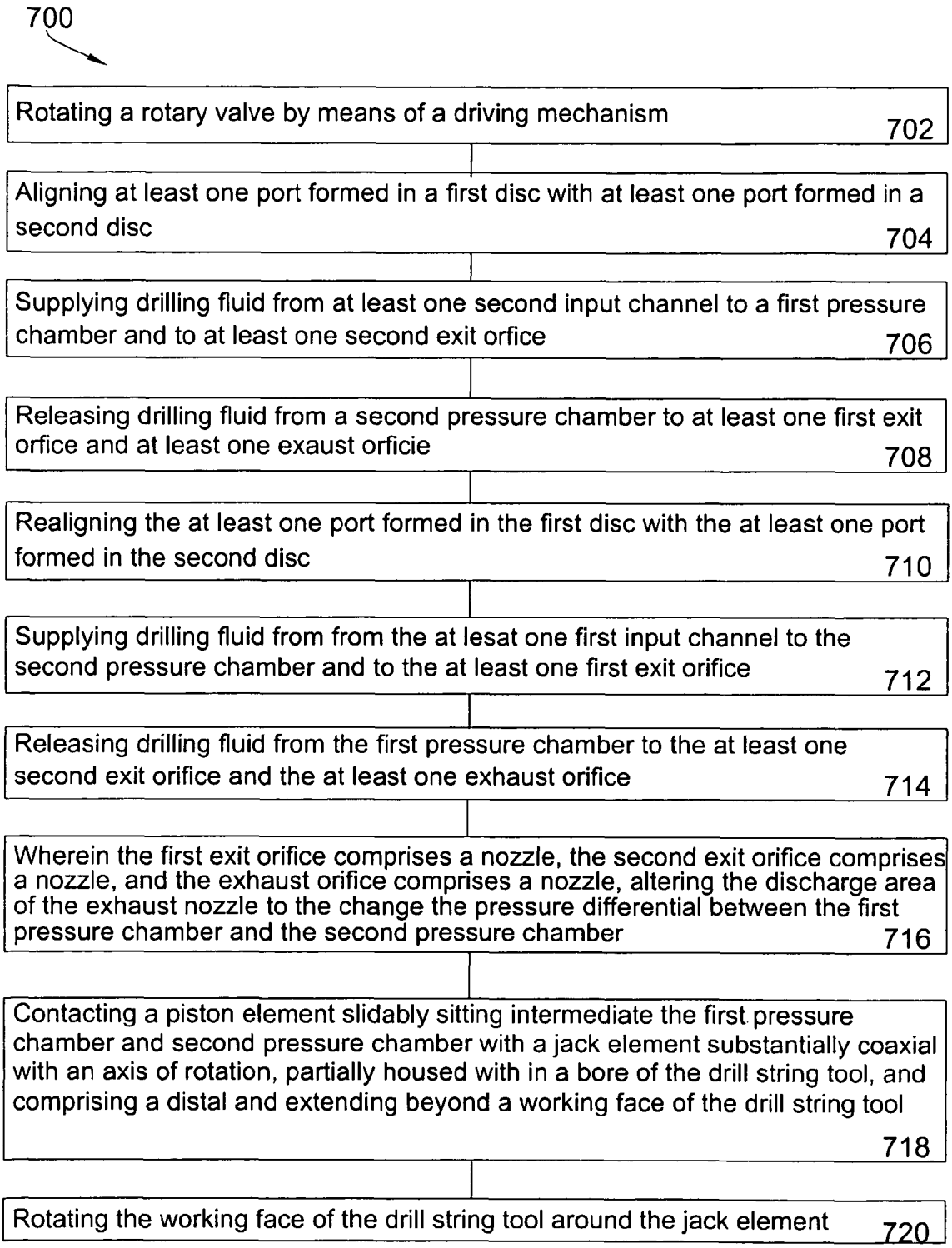
FIG. 7 is a flow diagram of an embodiment of a method of actuating a downhole drill string tool comprising a jack element.

FIG. 7 is a flow diagram of an embodiment of a method of actuating a downhole drill string tool comprising a jack element 700. Method 700 comprises the steps of rotating a rotary valve by means of a driving mechanism 702; aligning at least one port formed in a first disc with at least one port formed in a second disc 704; supplying drilling fluid from at least one second input channel to a first pressure chamber and to at least one second exit orifice 706; releasing drilling fluid from a second pressure chamber to at least one first exit orifice and at least one exhaust orifice 708; realigning the at least one port formed in the first disc with the at least one port formed in the second disc 710; supplying drilling fluid from the at least one first input channel to the second pressure chamber and to the at least one first exit orifice 712; releasing drilling fluid from the first pressure chamber to the at least one second exit orifice and the at least one exhaust orifice 714; wherein the first exit orifice includes a nozzle, the second exit orifice includes a nozzle, and the exhaust orifice includes a nozzle, altering the discharge area of the exhaust nozzle to change the pressure differential between the first pressure chamber and the second pressure chamber 716; contacting a piston element slidably sitting intermediate the first pressure chamber and second pressure chamber with a jack element substantially coaxial with an axis of rotation, partially housed within a bore of the drill string tool, and having a distal end extending beyond a working face of the drill string tool 718; and rotating the working face of the drill string tool around the jack element 720. It is believed that the percussive action of the jack element will help break up earthen formations that may be surrounding the downhole drill string tool and thus allow it to progress more rapidly through the earthen formations.

Figure 8:
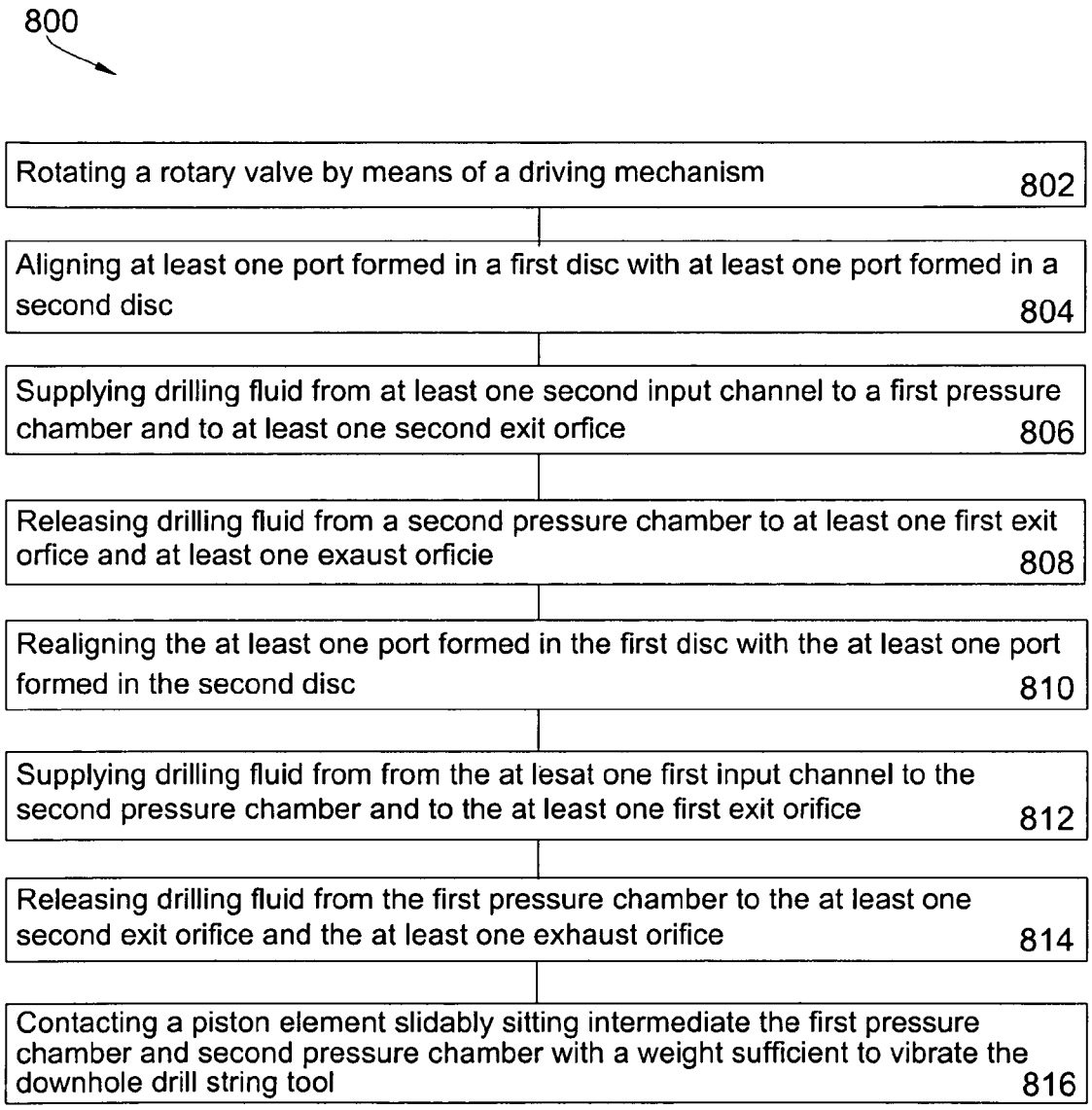
FIG. 8 is a flow diagram of an embodiment of a method of actuating a downhole drill string tool comprising vibrating means.

FIG. 8 is a flow diagram of an embodiment of a method of actuating a downhole drill string tool comprising vibrating means 800. Method 800 comprises the steps of rotating a rotary valve by means of a driving mechanism 802; aligning at least one port formed in a first disc with at least one port formed in a second disc 804; supplying drilling fluid from at least one second input channel to a first pressure chamber and to at least one second exit orifice 806; releasing drilling fluid from a second pressure chamber to at least one first exit orifice and at least one exhaust orifice 808; realigning the at least one port formed in the first disc with the at least one port formed in the second disc 810; supplying drilling fluid from the at least one first input channel to the second pressure chamber and to the at least one first exit orifice 812; releasing drilling fluid from the first pressure chamber to the at least one second exit orifice and the at least one exhaust orifice 814; and contacting a piston element slidably sitting intermediate the first pressure chamber and second pressure chamber with a weight sufficient to vibrate the downhole drill string tool 816. It is believed that the percussive action of the weight will help downhole drill string tool break free when caught on earthen formations that may be surrounding the downhole drill string tool and otherwise allow it to progress more rapidly through the earthen formations.

Whereas the present invention has been described in particular relation to the drawings attached hereto, it should be understood that other and further modifications apart from those shown or suggested herein, may be made within the scope and spirit of the present invention.

What is claimed is:

1. A downhole drill string tool, comprising:

a body having an axis and an axial interior chamber formed therein, said interior chamber having an inner surface;

a piston element disposed within said interior chamber, said piston element free to slide within said interior chamber, a first face, and a second face spaced apart from said first face, said first face and a first portion of said inner surface defining a first pressure chamber and said second face and a second portion of said inner surface defining a second pressure chamber;

at least one first input channel in fluid communication with said first pressure chamber and at least one second input channel in fluid communication with said second pressure chamber;

at least one first exit orifice in fluid communication with said first channel, at least one second exit orifice in fluid communication with said second channel, and at least one exhaust orifice;

a rotary valve comprising a first disc adapted to be coupled to a driving mechanism, said first disc having at least one through port adapted to receive a pressurized fluid and having at least one exit port in fluid communication with said exhaust orifice and a second disc axially aligned with said first disc, said second disc having at least one first access port in fluid communication with said first channel and at least one second access port in fluid communication with said second channel, said rotary valve configured to selectively align said at least one through port with said at least one first access port and said at least one exit port with said at least one second access port, and selectively align said at least one through port with said at least one second access port and said at least one exit port with said at least one first access port.

2. The downhole drill string tool of claim 1, wherein the piston element substantially isolates the first pressure chamber from the second pressure chamber.

3. The downhole drill string tool of claim 1, wherein the volume of the first pressure chamber is inversely proportional to the volume of the second pressure chamber.

4. The downhole drill string tool of claim 1, wherein the piston element comprises a weight sufficient to vibrate the downhole drill string tool.

5. The downhole drill string tool of claim 1, wherein the at least one first channel and the at least one second channel are formed between the interior chamber and an outer cylinder, and are separated by internal flutes running between the interior chamber and the outer cylinder.

6. The downhole drill string tool of claim 1, wherein at least one first exit orifice and the at least one second exit orifice are similar in area.

7. The downhole drill string tool of claim 1, wherein the first disc faces the second disc along a surface.

8. The downhole drill string tool of claim 1, wherein the first and second discs are formed from a material selected from the group of materials consisting of steel, chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix and silicon bounded diamond.

9. The downhole drill string tool of claim 1, comprising a jack element substantially coaxial with an axis of rotation of the drill string tool, the jack element being partially housed within a bore of the drill string tool and having a distal end extending beyond a working face of the drill string tool.

10. The downhole drill string tool of claim 9, wherein the jack element is formed from a material selected from a group of materials consisting of steel, chromium, tungsten, tantalum, niobium, titanium, molybdenum, carbide, natural diamond, polycrystalline diamond, vapor deposited diamond, cubic boron nitride, TiN, AlNi, AlTiNi, TiAlN, CrN/CrC/(Mo, W)S2, TiN/TiCN, AlTiN/MoS2, TiAlN, ZrN, diamond impregnated carbide, diamond impregnated matrix and silicon bounded diamond.

11. The downhole drill string tool of claim 1, wherein the first exit orifice comprises a first exit nozzle, the second exit orifice comprises a second exit nozzle, and the exhaust orifice comprises an exhaust nozzle.

12. The downhole drill string tool of claim 11, wherein the first exit nozzle and the second exit nozzle are similar in discharge area.

13. The downhole drill string tool of claim 1, comprising a weight sufficient to vibrate the downhole drill string tool and in mechanical communication with the piston element.

14. A method of actuating a downhole drill string tool, the method comprising:

accessing a downhole drill string tool having a body with an axial interior chamber formed therein, a piston element disposed within said interior chamber, said piston element free to slide within said interior chamber divided into a first pressure chamber and a second pressure chamber, said first pressure chamber and said second pressure chamber separated by said piston element;

rotating a rotary valve with a driving mechanism;

aligning at least one through port formed in a first disc with at least one first access port formed in a second disc in communication with a first channel;

supplying drilling fluid from the at least one through port to the first pressure chamber and to at least one first exit orifice in communication with the first channel while releasing drilling fluid from the second pressure chamber to at least one second exit orifice and at least one exhaust orifice;

realigning the at least one through port formed in the first disc with at least one second access port formed in the second disc in communication with a second channel; and supplying drilling fluid from the at least one through port to the second pressure chamber and to the at least one second exit orifice in communication with the second channel while releasing drilling fluid from the first pressure chamber to the at least one first exit orifice and the at least one exhaust orifice.

15. The method of claim 14, further comprising moving the piston element into contact with a jack element positioned substantially coaxial with an axis of rotation of the drill string tool, the jack element being partially housed within the interior chamber and having a distal end extending beyond a working face of the drill string tool.

16. The method of claim 15, further comprising rotating the working face of the drill string tool around the jack element.

17. The method of claim 14, wherein the first exit orifice includes a first nozzle, the second exit orifice includes a second nozzle, and the exhaust orifice comprises a third nozzle.

18. The method of claim 17, further comprising altering the discharge area of the exhaust nozzle to change the pressure differential between the first pressure chamber and the second pressure chamber.

19. The method of claim 14, further comprising moving the piston element into contact with a weight at least partially housed within the interior chamber and with an impact force sufficient to vibrate the downhole drill string tool.

20. The method of claim 14, wherein rotating the rotary valve with a driving mechanism further comprises passing drilling fluid through a downhole turbine in mechanical communication with the rotary valve to rotate the rotary valve.

* * * * *